US009986783B2

(12) United States Patent
Gou

(10) Patent No.: US 9,986,783 B2
(45) **Date of Patent: *Jun. 5, 2018**

(54) SHOE WITH SOUND AND LIGHT DEVICE

(71) Applicant: TERRY ELECTRONCS (S.Z) CO., LTD., Baoan Distric, Shenzhen, Guangdong (CN)

(72) Inventor: John Gou, Guangdong (CN)

(73) Assignee: TERRY ELECTRONICS (S.Z) CO., LTD. (CN)

( * ) Notice: Subject to any disclaimer, the term of this patent is extended or adjusted under 35 U.S.C. 154(b) by 16 days.

This patent is subject to a terminal disclaimer.

(21) Appl. No.: 14/802,368

(22) Filed: Jul. 17, 2015

(65) Prior Publication Data

US 2017/0013908 A1 Jan. 19, 2017

(51) Int. Cl.

| | |
|---|---|
| ***F21V 21/08*** | (2006.01) |
| ***A43B 3/00*** | (2006.01) |
| ***F21V 33/00*** | (2006.01) |
| ***H04R 1/02*** | (2006.01) |
| *F21S 9/02* | (2006.01) |
| *H04R 3/00* | (2006.01) |

(52) U.S. Cl.

CPC ..... *A43B 3/001* (2013.01); *A43B 3/0021* (2013.01); *F21V 33/0008* (2013.01); *H04R 1/028* (2013.01); *F21S 9/02* (2013.01); *H04R 3/00* (2013.01)

(58) Field of Classification Search

CPC ..... A43B 3/001; A43B 3/0021; F21S 9/02; F21V 33/0008; H04R 1/028; H04R 3/00; G10L 13/043

USPC ..... 362/103

See application file for complete search history.

(56) References Cited

U.S. PATENT DOCUMENTS

| | | | | |
|---|---|---|---|---|
| 7,057,354 | B2 * | 6/2006 | Wong | H05B 37/029 315/200 A |
| 9,055,778 | B1 * | 6/2015 | Kelley | A43B 3/001 |

* cited by examiner

*Primary Examiner* — Elmito Breval
*Assistant Examiner* — Jessica M Apenteng
(74) *Attorney, Agent, or Firm* — Garcia-Zamor IP Law; Ruy M. Garcia-Zamor

(57) ABSTRACT

A sound and light shoe includes a shoe body including a sole and a sound and light device located in the shoe body. The sound and light device includes a controlling box received in the sole, a sound and light member, and a battery located in the controlling box to supply power to the sound and light member. The sound and light member includes a controlling circuit received in the controlling box including a main PCB having a MPU, a first controlling circuit connected to the main PCB, and a second controlling circuit connected to the main PCB and the first controlling circuit, a light-emitting body connected to the controlling circuit, a first controlling switch connected to the main PCB, a sound-phonating body connected to the controlling circuit, a trigger switch connected to the main PCB, and a second controlling switch connected to the main PCB.

18 Claims, 3 Drawing Sheets

SHOE WITH SOUND AND LIGHT DEVICE

BACKGROUND

1. Technical Field

The present disclosure generally relates to shoes, and especially to a shoe with a sound and light device.

2. Description of Related Art

Luminous shoes are popular with children and young people due to the fashion appearance and safety of the luminous shoes. When people wear the luminous shoes, the luminous shoes generally emit lights with various colors to highlight the personalization and the fashion of the shoes.

The luminous shoe generally includes a light-emitting device mounted on a sole of the shoe, and the light-emitting device flashes light in light of movement of the shoe. However, the light-emitting device has only one light-emitting mode and cannot make a sound, resulting in that the shoe cannot meet demands of a user.

Therefore, a need exists in the industry to overcome the described problems.

SUMMARY

The objection of the present invention is to overcome the shortcomings in the prior art and provide a shoe with sound and light device having multiple light-emitting modes and multiple sound-phonating modes.

In order to solve the problem, the disclosure offers technical proposal as follow.

A sound and light shoe, comprising:

a shoe body comprising a sole; and a sound and light device located in the shoe body, the sound and light device comprising:

a controlling box received in the sole;

a sound and light member comprising:

a controlling circuit received in the controlling box and comprising a main printed circuit board (PCB) having a micro processor unit (MPU), a first controlling circuit connected to the main PCB, and a second controlling circuit connected to the main PCB and the first controlling circuit;

a light-emitting body connected to the controlling circuit;

a first controlling switch connected to the main PCB, wherein the first controlling switch is used to trigger the first controlling circuit in light of a first movement of the shoe body, so that the light-emitting body emits light in a predetermined light-emitting mode;

a sound-phonating body connected to the controlling circuit;

a trigger switch connected to the main PCB; and a second controlling switch connected to the main PCB and controlling on/off of the trigger switch, wherein the trigger switch is used to trigger the second controlling circuit so that the light-emitting body emits light in the predetermined light-emitting mode and the sound-phonating body phonates in a predetermined sound-phonating mode; and a battery located in the controlling box to supply power to the sound and light member;

wherein when the second controlling switch is in an open state, the first controlling switch cannot trigger the first controlling circuit so that the light-emitting body cannot emit light in the predetermined light-emitting mode; and wherein when the second controlling switch is in a closed state, the trigger switch cannot trigger the second controlling circuit so that the light-emitting body cannot emit light in the predetermined light-emitting mode and the sound-phonating body cannot phonate in the predetermined sound-phonating mode.

The trigger switch is one of an infrared switch, a touch switch, and an inductive switch; and wherein the second controlling switch is on/off by one of pressing the second controlling switch and a remote.

The light-emitting body comprises a plurality of a first son PCBs connected to the main PCB and a plurality of light sources located on the first son PCBs.

The predetermined light-emitting mode is that the light sources first flash N times simultaneously, next respectively flash twice sequentially, thirdly respectively flash twice reversely, fourth respectively flash twice sequentially, and finally flash N times simultaneously, wherein N is an integral number larger than or equal to 1.

The predetermined light-emitting mode is that the light sources first flash once sequentially at intervals, next flash once reversely at intervals, thirdly first flash once sequentially at intervals, and finally flash N times simultaneously, wherein N is an integral number larger than or equal to 1, and the intervals is 10 to 15 milliseconds.

The predetermined light-emitting mode is that the light sources first flash sequentially N times when the first controlling switch is triggered N times, and in the case of N+1 triggering, three of the light sources flash sequentially, then simultaneously flash pairwise, and finally all the light sources flash simultaneously, wherein N is an integral number larger than or equal to 1.

The sound-phonating body comprises at least one second son PCB connected to the main PCB and at least one speaker located on the second son PCB, the second son PCB have an audio module having a plurality of audio elements.

The predetermined sound-phonating mode is that the speaker first sounds the audio elements sequentially, and then sounds the audio elements reversely, and then the speaker remains dormant for a first predetermined time.

The predetermined sound-phonating mode is that the speaker first sounds the audio elements once sequentially at intervals, next sounds the audio elements once reversely at intervals, and then sounds the audio elements once sequentially at intervals, wherein the intervals is 10 to 15 milliseconds.

The second controlling switch is on/off by a second movement of the shoe body that the shoe body is vibrated N times in a second predetermined time, wherein N is an integral number larger than or equal to 2.

Because the light-emitting body can emit in multiple modes, the light-emitting body can serve as an auxiliary illumination source when a user walks at night under poor illumination, and can increase the playing and walking pleasure at night by means of diversified light-emitting modes. In addition, the sound-phonating body can sound in multiple modes, resulting in increasing the playing and walking pleasure by means of diversified sound-phonating modes.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
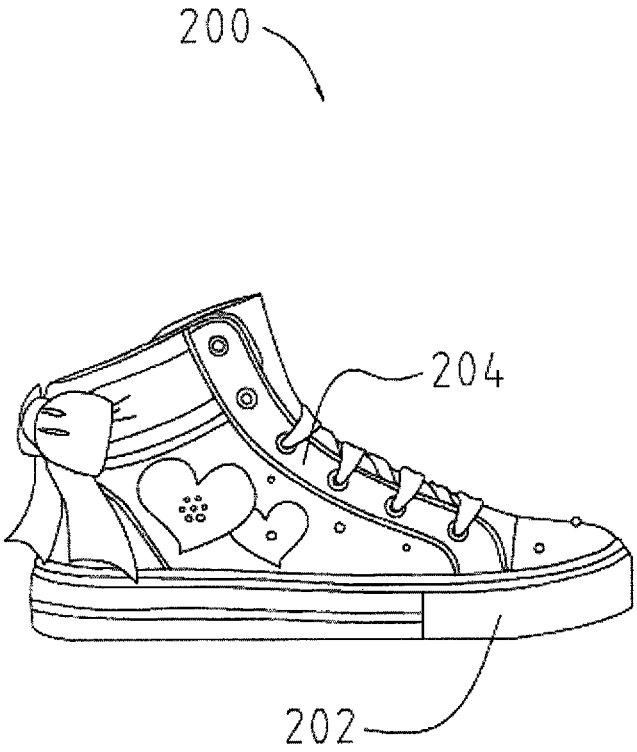
FIG. 1 is an exploded view of a sound and light shoe of the disclosure.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Figure 2:
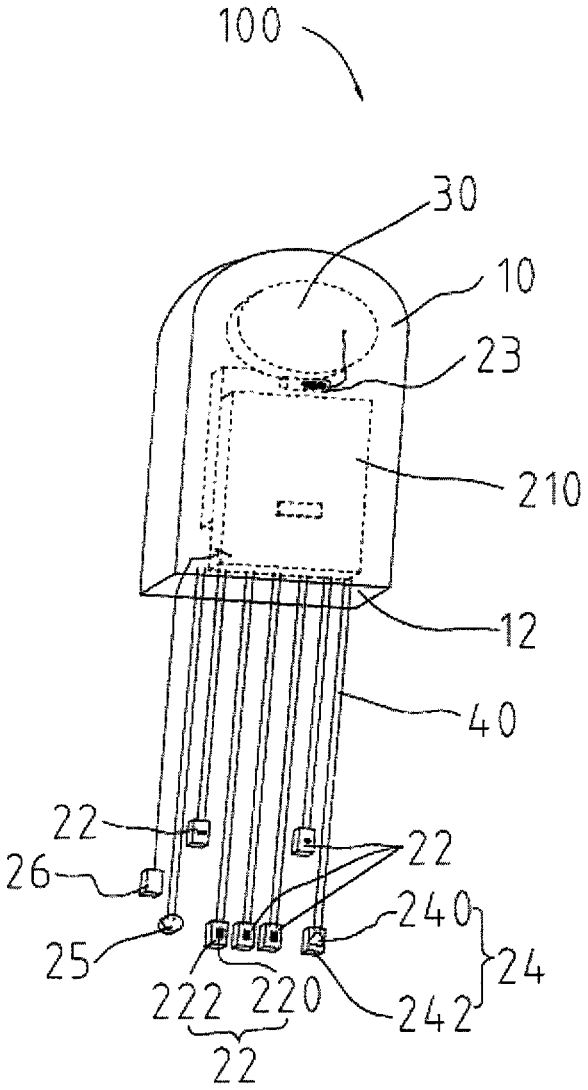
FIG. 2 is a schematic perspective view of a sound and light device of FIG. 1.

Referring to FIG. 1 and FIG. 2, a sound and light shoe of the present invention includes a shoe body 200 and a sound and light device 100 located in the shoe body 200. The shoe body 200 includes a sole 202 and upper 204 connected to the sole 202.

The sound and light device 100 includes a controlling box 10, a sound and light member 20 (referring to FIG. 3), and a battery 30. The controlling box 10 is received in the sole 202 and defines a receiving space 12.

Figure 3:
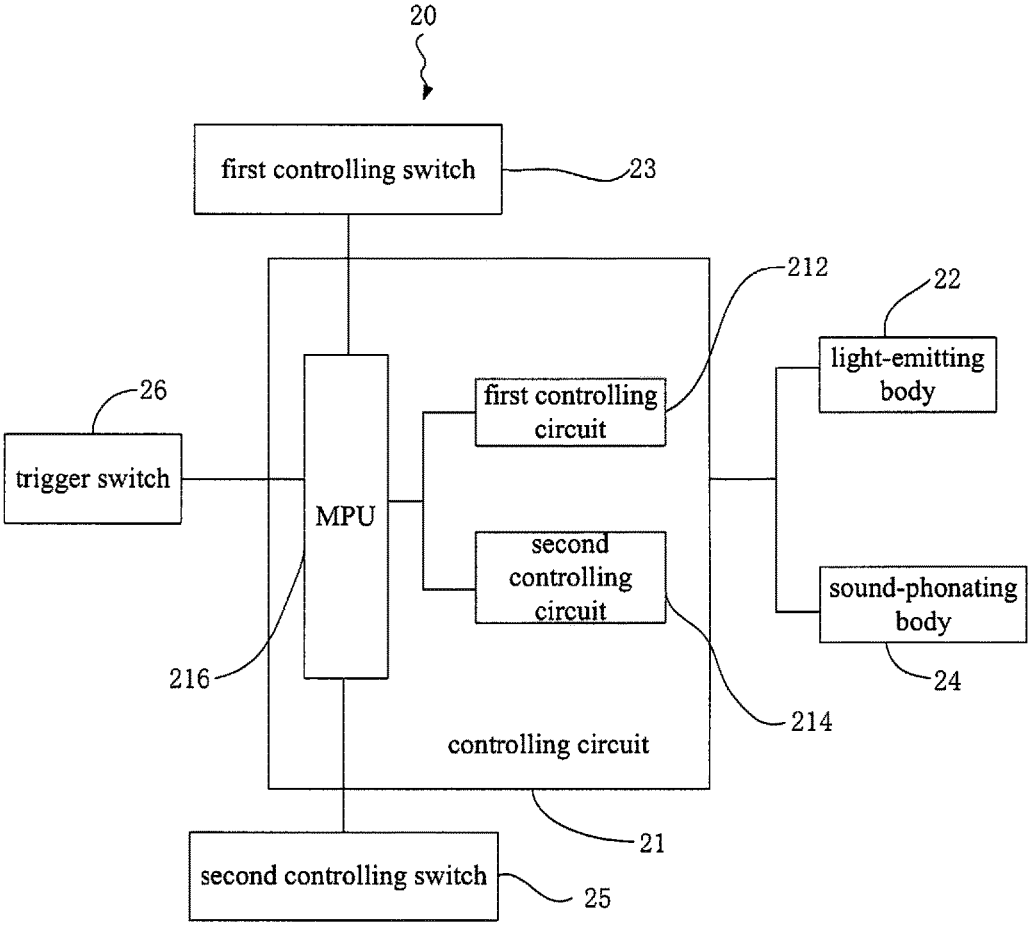
FIG. 3 is a schematic module diagram of a sound and light member of FIG. 2.

Referring to FIGS. 1-3, the sound and light member 20 includes a controlling circuit 21 received in the controlling box 10, a light-emitting body 22 connected to the controlling circuit 21, a first controlling switch 23, a sound-phonating body 24 connected to the controlling circuit 21, a second controlling switch 25, and a trigger switch 26. The controlling circuit 21 includes a main printed circuit board (PCB) 210 having a micro processor unit (MPU) 216, a first controlling circuit 212 connected to the main PCB 210, and a second controlling circuit 214 connected to the main PCB 210 and the first controlling circuit 212. The first controlling switch 23 is connected to the main PCB 210, and is used to trigger the first controlling circuit 212 in light to a first movement of the shoe body 200 that the shoe body 200 is vibrated, so that the light-emitting body 22 emits light in a predetermined light-emitting mode. The trigger switch 26 is connected to the main PCB 210. The second controlling switch 25 is connected to the main PCB 210 and controls on/off of the trigger switch 26. The trigger switch 26 is used to trigger the second controlling circuit 214 so that the light-emitting body 22 emits light in the predetermined light-emitting mode and the sound-phonating body 24 phonates in a predetermined sound-phonating mode. The battery 30 is located in the controlling box 10 to supply power to the sound and light member 20. When the second controlling switch 25 is in an open state, the first controlling switch 23 cannot trigger the first controlling circuit 212 so that the light-emitting body 22 cannot emit light in the predetermined light-emitting mode. When the second controlling switch 25 is in a closed state, the trigger switch 26 cannot trigger the second controlling circuit 214 so that the light-emitting body 22 cannot emit light in the predetermined light-emitting mode and the sound-phonating body 24 cannot phonate in the predetermined sound-phonating mode.

In the embodiment, the second controlling switch 25 is on/off by pressing the second controlling switch 25 or a remote.

In other embodiment, the second controlling switch 25 is on/off by a second movement of the shoe body 200 that the shoe body 200 is vibrated N times in a second predetermined time, wherein N is an integral number larger than or equal to 2, for example, N=2, 3, or 4, and so on. The second predetermined time is one seconds or two seconds.

In the embodiment, the trigger switch 26 is an infrared switch or an inductive switch or a touch switch. When the trigger switch 26 of one of a pair of the shoe bodies 200 touches the trigger switch 26 of the other of the pair of shoe bodies 200, or when the trigger switch 26 of one of a pair of the shoe bodies 200 is close to the trigger switch 26 of the other of the pair of shoe bodies 200, the trigger switch 26 triggers the second controlling circuit 214 so that the light-emitting body 22 emits light in the predetermined light-emitting mode and the sound-phonating body 24 phonates in the predetermined sound-phonating mode.

In other embodiment, when the trigger switch 26 of any one of the pair of shoe bodies 200 is touched, the trigger switch 26 triggers the second controlling circuit 214 so that the light-emitting body 22 emits light in the predetermined light-emitting mode and the sound-phonating body 24 phonates in the predetermined sound-phonating mode.

In one embodiment, the battery 30 is a micro-current lithium manganese button cell.

The main PCB 210, the first controlling switch 23, and the battery 30 are accommodated in the controlling box 10. The light-emitting body 22, the second controlling switch 25, the trigger switch 26, and the sound-phonating body 24 are located in a sidewall of the sole 202 or the upper 204 of the shoe body 200, or some of the light-emitting body 22, the second controlling switch 25, the trigger switch 26, and the sound-phonating body 24 are located in a sidewall of the sole 202, and the other are located at the upper 204 of the shoe body 200.

The light-emitting body 22 includes a plurality of light sources 220, i.e. Light emitting diode, and a plurality of first son PCB 222. Positive and negative electrodes of the main PCB 210 are electrically coupled to corresponding electrodes of the first son PCBs 222 respectively by wires 40. One ends of the wires 40 are welded to corresponding electrodes of the main PCB 210, while the other ends are weld to corresponding electrodes of the first son PCBs 222. In the embodiment, the light sources 220 include L1, L2, L3, L4, and L5.

In other embodiment, light-emitting body 22 is connected to the main PCB 210 by wireless.

The light sources 220 can emit different color light, or identical color light, for example, L1 emits red light, L2 emits hollow light, L3 emits green light, L4 emits blue light, L5 emit purple light and so on, or the light sources 200 simultaneously emit white light or multicolor light.

In a first embodiment, the predetermined light-emitting mode is that the light sources 220 first flash N times simultaneously, next respectively flash twice sequentially, thirdly respectively flash twice reversely, fourth respectively flash twice sequentially, and finally flash N times simultaneously, wherein N is an integral number larger than or equal to 1, for example, N=1, 2, 3, . . . . Specially, five light sources 220 first flash once simultaneously, next respectively flash twice sequentially (L1-L1, L2-L2, L3-L3, L4-L4, L5-L5), thirdly respectively flash twice reversely (L5-L5, L4-L4, L3-L3, L2-L2, L1-L1), fourth respectively flash twice sequentially (L1-L1, L2-L2, L3-L3, L4-L4, L5-L5), and finally flash twice simultaneously.

In a second embodiment, the predetermined light-emitting mode is that the light sources 220 first flash once sequentially at intervals, next flash once reversely at intervals, thirdly first flash once sequentially at intervals, and finally flash N times simultaneously, wherein N is an integral number larger than or equal to 1, and the intervals is 10 to 15 milliseconds. Specially, the light sources 220 first flash in a sequence of L1-L2-L3-L4-L5 at intervals for 10 to 15 milliseconds, next flash in a reversed sequence of L5-L4-L3-L2-L1 at intervals for 10 to 15 milliseconds, thirdly flash in a sequence of L1-L2-L3-L4-L5 at intervals for 10 to 15 milliseconds, and finally flash twice simultaneously.

In a third embodiment, the predetermined light-emitting mode is that the light sources 220 first flash sequentially N times when triggered N times by the first controlling switch 23, next in the case of N+1 times triggering, three of the light sources 220 flash sequentially N+1 times, thirdly simultaneously flash pairwise, and finally all of the light sources 220 flash simultaneously, wherein N is an integral number larger than or equal to 1. Specially, the light sources 220 first flash three times in a sequence of L1-L2-L3-L4-L5 when triggered three times by the first controlling switch 23, next that triggering fourth times enables L3-L4-L5 to flash sequentially four times, thirdly L3 and L4 flash simultaneously, L4 and L5 flash simultaneously, and L3 and L5 flash simultaneously, and finally L4, L5, and L3 flash simultaneously.

In a fourth embodiment, the predetermined light-emitting mode is that, the light sources 220 L1 to L5 respectively flash twice when triggered by the first controlling switch 23, and after triggering N times, three light sources 220 sequentially when being triggered N+1 times, then simultaneously flash pairwise, and finally all of the light sources 220 flash simultaneously, wherein N is an integral number larger than or equal to 1. Specially, after L1-L1, L2-L2, L3-L3, L4-L4 and L5-L5 respectively light three times, L3-L4-L5 sequentially flash during fourth times, afterwards, L3 and L4 flash simultaneously, L4 and L5 flash simultaneously, and L3 and L5 flash simultaneously, and finally L4, L5, and L3 flash simultaneously.

The sound-phonating body 24 comprises at least one second son PCB 242 connected to the main PCB 210 and at least one speaker 240 located on the second son PCB 242, the second son PCB 242 have an audio module having a plurality of audio elements, for example, song, cartoon sound, and so on. In one embodiment, the audio elements include S1, S2, S3, S4, S5.

In other embodiment, the sound-phonating body 24 comprises a plurality of second son PCBs 242 connected to the main PCB 210 and a plurality of speakers 240 located on the second son PCBs 242, each of the second son PCB 242 have an audio module having an audio element.

Positive and negative electrodes of the main PCB 210 are electrically coupled to corresponding electrodes of the second son PCBs 242 respectively by wires 40. One ends of the wires 40 are welded to corresponding electrodes of the main PCB 210, while the other ends are weld to corresponding electrodes of the second son PCBs 242.

In other embodiment, the sound-phonating body 24 is electrically connected to the main PCB 210 by wireless.

In a first embodiment, the predetermined sound-phonating mode is that the speaker 240 first sounds the audio elements sequentially, and then sounds the audio elements reversely, then the speaker 240 remains dormant for a first predetermined time. In the embodiment, the first predetermined time is N seconds, wherein N is an integral number larger than or equal to 1, for example, N=1, 2, 3, 4. Specially, the speaker 240 first sounds in a sequence of S1-S2-S3-S4-S5, next sounds in a reversed sequence of S5-S4-S3-S2-S1, and then the speaker 240 remains dormant for one seconds.

In a second embodiment, the predetermined sound-phonating mode is that the speaker 240 first sounds the audio elements once sequentially at intervals, and then sounds the audio elements once reversely at intervals, and then sounds the audio elements once sequentially at intervals, wherein the intervals is 10 to 15 milliseconds. Specially, the speaker 240 first phonates in a sequence of S1-S2-S3-S4-S5 at intervals of 10 to 15 milliseconds, next phonates in a reversed sequence of S5-S4-S3-S2-S1 at intervals of 10 to 15 milliseconds, and then phonates in a sequence of S1-S2-S3-S4-S5 at intervals of 10 to 15 milliseconds.

In the embodiment, the second controlling circuit 214 has a timer to control the speaker 240. In the embodiment, the timer sets a sounding time that the speaker 240 can phonate, and in the sounding time, the speaker 240 can sound, otherwise the speaker 240 does not phonate.

Because the light-emitting body 22 can emit in multiple modes, the light-emitting body 22 can serve as an auxiliary illumination source when a user walks at night under poor illumination, and can increase the playing and walking pleasure at night by means of diversified light-emitting modes. In addition, the sound-phonating body 24 can sound in multiple modes, resulting in further increasing the playing and walking pleasure by means of diversified sound-phonating modes.

Because the light sources 200 can emit in multiple modes and different color light simultaneously, the sound and light shoe 100 further increases the playing and walking pleasure at night.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A sound and light shoe, comprising:

a shoe body comprising a sole; and a sound and light device located in the shoe body, the sound and light device comprising:

a controlling box received in the sole;

a sound and light member comprising:

a controlling circuit received in the controlling box and comprising a main printed circuit board (PCB) having a micro processor unit (MPU), a first controlling circuit connected to the main PCB, and a second controlling circuit connected to the main PCB and the first controlling circuit;

a light-emitting body connected to the controlling circuit;

a first controlling switch connected to the main PCB, wherein the first controlling switch is used to trigger the first controlling circuit in light of a first movement of the shoe body, so that the light-emitting body emits light in a predetermined light-emitting mode;

a sound-phonating body connected to the controlling circuit;

a trigger switch connected to the main PCB; and a second controlling switch connected to the main PCB and controlling on/off of the trigger switch, wherein the trigger switch is used to trigger the second controlling circuit so that the light-emitting body emits light in the predetermined light-emitting mode and the sound-phonating body phonates in a predetermined sound-phonating mode; and a battery located in the controlling box to supply power to the sound and light member;

wherein when the second controlling switch is in an open state, the first controlling switch cannot trigger the first controlling circuit so that the light-emitting body cannot emit light in the predetermined light-emitting mode; and wherein when the second controlling switch is in a closed state, the trigger switch cannot trigger the second controlling circuit so that the light-emitting body cannot emit light in the predetermined light-emitting mode and the sound-phonating body cannot phonate in the predetermined sound-phonating mode;

wherein the trigger switch is one of an infrared switch, a touch switch, and an inductive switch; and wherein the second controlling switch is on/off by one of pressing the second controlling switch and a remote.

2. The sound and light shoe of claim 1, wherein the light-emitting body comprises a plurality of a first son PCBs connected to the main PCB and a plurality of light sources located on the first son PCBs.

3. The sound and light shoe of claim 2, wherein the predetermined light-emitting mode is that the light sources first flash N times simultaneously, next respectively flash twice sequentially, thirdly respectively flash twice reversely, fourth respectively flash twice sequentially, and finally flash N times simultaneously, wherein N is an integral number larger than or equal to 1.

4. The sound and light shoe of claim 2, wherein the predetermined light-emitting mode is that the light sources first flash once sequentially at intervals, next flash once reversely at intervals, thirdly first flash once sequentially at intervals, and finally flash N times simultaneously, wherein N is an integral number larger than or equal to 1, and the intervals is 10 to 15 milliseconds.

5. The sound and light shoe of claim 2, wherein the predetermined light-emitting mode is that the light sources first flash sequentially N times when the triggered N times by the first controlling switch, and in the case of N+1 triggering, three of the light sources flash sequentially N+1 times, next simultaneously flash pairwise, and finally all the light sources flash simultaneously, wherein N is an integral number larger than or equal to 1.

6. The sound and light shoe of claim 1, wherein the sound-phonating body comprises at least one second son PCB connected to the main PCB and at least one speaker located on the second son PCB, the second son PCB have an audio module having a plurality of audio elements.

7. The sound and light shoe of claim 6, wherein the predetermined sound-phonating mode is that the speaker first sounds the audio elements sequentially, and then sounds the audio elements reversely, and then the speaker remains dormant for a first predetermined time.

8. The sound and light shoe of claim 6, wherein the predetermined sound-phonating mode is that the speaker first sounds the audio elements once sequentially at intervals, next sounds the audio elements once reversely at intervals, and then sounds the audio elements once sequentially at intervals, wherein the intervals is 10 to 15 milliseconds.

9. The sound and light shoe of claim 1, wherein the second controlling switch is on/off by a second movement of the shoe body that the shoe body is vibrated N times in a second predetermined time, wherein N is an integral number larger than or equal to 2.

10. A sound and light device arranged in a shoe body comprising a sole, the sound and light device comprising:

a controlling box received in the sole;

a sound and light member comprising:

a controlling circuit received in the controlling box and comprising a main printed circuit board (PCB) having a micro processor unit (MPU), a first controlling circuit connected to the main PCB, and a second controlling circuit connected to the main PCB and the first controlling circuit;

a light-emitting body connected to the controlling circuit;

a first controlling switch connected to the main PCB, wherein the first controlling switch is used to trigger the first controlling circuit in light of a first movement of the shoe body, so that the light-emitting body emits light in a predetermined light-emitting mode;

a sound-phonating body connected to the controlling circuit;

a trigger switch connected to the main PCB; and a second controlling switch connected to the main PCB and controlling on/off of the trigger switch, wherein the trigger switch is used to trigger the second controlling circuit so that the light-emitting body emits light in the predetermined light-emitting mode and the sound-phonating body phonates in a predetermined sound-phonating mode; and a battery located in the controlling box to supply power to the sound and light member;

wherein when the second controlling switch is in an open state, the first controlling switch cannot trigger the first controlling circuit so that the light-emitting body cannot emit light in the predetermined light-emitting mode; and wherein when the second controlling switch is in a closed state, the trigger switch cannot trigger the second controlling circuit so that the light-emitting body cannot emit light in the predetermined light-emitting mode and the sound-phonating body cannot phonate in the predetermined sound-phonating mode;

wherein the trigger switch is one of an infrared switch, a touch switch, and an inductive switch; and wherein the second controlling switch is on/off by one of pressing the second controlling switch and a remote.

11. The sound and light device of claim 10, wherein the light-emitting body comprises a plurality of a first son PCBs connected to the main PCB and a plurality of light sources located on the first son PCBs.

12. The sound and light device of claim 11, wherein the predetermined light-emitting mode is that the light sources first flash N times simultaneously, next respectively flash twice sequentially, thirdly respectively flash twice reversely, fourth respectively flash twice sequentially, and finally flash N times simultaneously, wherein N is an integral number larger than or equal to 1.

13. The sound and light device claim 11, wherein the predetermined light-emitting mode is that the light sources first flash once sequentially at intervals, next flash once reversely at intervals, thirdly first flash once sequentially at intervals, and finally flash N times simultaneously, wherein N is an integral number larger than or equal to 1, and the intervals is 10 to 15 milliseconds.

14. The sound and light device of claim 11, wherein the predetermined light-emitting mode is that the light sources first flash sequentially N times when triggered N times by the first controlling switch, and in the case of N+1 triggering, three of the light sources flash sequentially, next simultaneously flash pairwise, and finally all the light sources flash simultaneously, wherein N is an integral number larger than or equal to 1.

15. The sound and light device of claim 10, wherein the sound-phonating body comprises at least one second son PCB connected to the main PCB and at least one speaker located on the second son PCB, the second son PCB have an audio module having a plurality of audio elements.

16. The sound and light device of claim 15, wherein the predetermined sound-phonating mode is that the speaker first sounds the audio elements sequentially, and then sounds the audio elements reversely, and then the speaker remains dormant for a first predetermined time.

17. The sound and light device of claim 15, wherein the predetermined sound-phonating mode is that the speaker first sounds the audio elements once sequentially at intervals, next sounds the audio elements once reversely at intervals, and then sounds the audio elements once sequentially at intervals, wherein the intervals is 10 to 15 milliseconds.

18. The sound and light device of claim 10, wherein the second controlling switch is on/off by a second movement of the shoe body that the shoe body is vibrated N times in a second predetermined time, wherein N is an integral number larger than or equal to 2.

* * * * *